United States Patent [19]

Blackwell

[11] 4,317,407

[45] Mar. 2, 1982

[54] SWAB CUP HAVING AN INTERNAL REINFORCING MEMBER

[75] Inventor: Henry W. Blackwell, Venus, Tex.

[73] Assignee: Dresser Industries, Inc., Dallas, Tex.

[21] Appl. No.: 122,223

[22] Filed: Feb. 19, 1980

[51] Int. Cl.[3] ..... B29F 1/10; F16J 9/08; F16J 15/32

[52] U.S. Cl. ..... 92/241; 29/460; 166/202; 417/555 A; 264/274; 264/275

[58] Field of Search ..... 92/241, 254; 417/555 A; 166/202; 29/460, 156.5 R; 264/274, 275

[56] References Cited

U.S. PATENT DOCUMENTS 2,305,282 12/1942 Taylor, Jr. et al. .

2,711,939 6/1955 Losey ..... 92/241

3,724,337 4/1973 Richardson ..... 92/241

4,099,451 7/1978 Blackwell ..... 92/241

4,106,182 8/1978 Blackwell ..... 29/460

*Primary Examiner*—Irwin C. Cohen

*Attorney, Agent, or Firm*—J. N. Hazelwood; W. R. Peoples

[57] ABSTRACT

A well swab cup has an annular bushing for supporting a plurality of longitudinally extending wire reinforcing members within an elastomeric cup-like body. The reinforcing members are supported by a base cup around the lower portion of the bushing and extending upward within the body. An internal elongated hollow reinforcing member extends upward from the base cup within the pattern of the wire reinforcing members and within the elastomeric, cup-like body.

9 Claims, 8 Drawing Figures

SWAB CUP HAVING AN INTERNAL REINFORCING MEMBER

TECHNICAL FIELD

This invention is related to internal constructions for well swab cups. More specifically, the invention is related to the internal construction of a swab cup that has an elongated, hollow reinforcing member within the elastomeric cup-like body and also within the support structure of the wire reinforcing members.

BACKGROUND OF THE INVENTION

The ability of a swab cup to pick up light loads as well as heavy loads depends upon the cup's ability to deform in accordance with the operating load conditions of a particular well. For light load operation, the swab cup must deform with less force or fluid weight acting on the cup than is present during heavy load operation. In light load operation, the swab cup must deform under the light weight fluid load so the outer periphery of the swab cup contacts the interior wall of a well's tubing in order that the swab cup can pick up and transport well fluid through the well tubing. In heavy load operation, the interior portion of the swab cup is subjected to a substantially greater load than is necessary to expand the swab cup to sealing contact against the interior of the well tubing. In other words, when operating in a heavy load condition, the swab cup is basically subjected to an internal fluid pressure load in excess of that necessary to seal against the well tubing. The loading condition of a swab cup is dependent upon the height of fluid above the swab cup while it is being withdrawn from a well in addition to the velocity at which the swab cup is being withdrawn.

In prior art swab cup constructions, the internal reinforcing members have strongly supported locations around some portions of the swab cup body and weaker supported locations at other portions of the swab cup body. One such weaker location is immediately above the base portion of the internal support structure. As a result of this, some prior art swab cups will exhibit a tendency to perforate or blow out at a location immediately above this base portion when they are subjected to heavy fluid loading conditions.

SUMMARY OF THE INVENTION

In an embodiment, a swab cup structure includes an elastomeric cup-like body containing an annular U-shaped base cup in its lower end portion with a plurality of wires or reinforcing members mounted around the interior of the base cup and extending upward. The reinforcing members or wires extend to the upper end of the swab cup through the elastomeric body. The hollow internal reinforcing member extends upward from the base cup within the elastomeric body and within the interior of the fence-like support formed by the wires supporting members. The hollow reinforcing member functions to strengthen the elastomeric body for support of heavy loads by the swab cup.

One object of this invention is to provide a swab cup structure overcoming the aforementioned disadvantages of the prior art devices.

Still, one other object of this invention is to provide a swab cup structure which has a hollow internal reinforcing member to strengthen the side wall lower portion in order to enable the swab cup to pick up and transport relatively heavy well fluid loads without the occasional rupture or blow out through the elastomeric body above the base cup.

Various other objects, advantages, and features of this invention will become apparent to those skilled in the art from the following discussion, taken in conjunction with the accompanying drawing.

DETAILED DESCRIPTION

Figure 1:
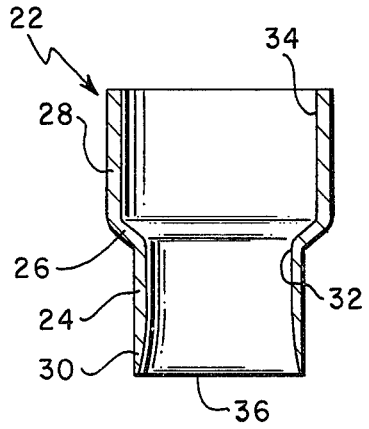
FIG. 1 is a cross-sectional side elevation view of one embodiment, (1), of the hollow internal reinforcement member of this invention.
Figure 2:
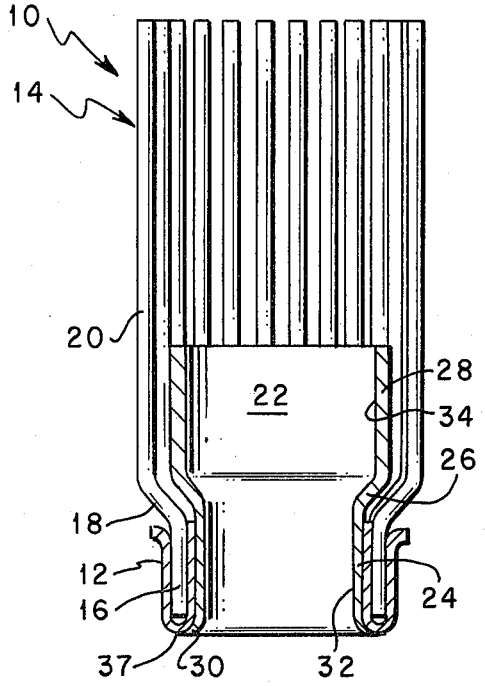
FIG. 2 is a cross-sectional side elevation view of a bushing or reinforcement member of FIG. 1 alone taken at the location of line 2—2 in FIG. 3 and having the hollow internal reinforcement member shown in FIG. 1.
Figure 3:
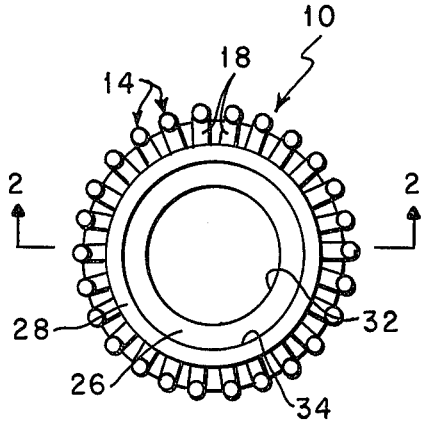
FIG. 3 is a top end view of the bushing or reinforcement structure shown in FIG. 2.

Referring to sheet 1 of the drawings and in particular FIGS. 1–3, the swab cup of this embodiment, (1), of this invention has a reinforcing structure or bushing, indicated generally at 10, for use in supporting the elastomeric swab cup body. This reinforcing structure is typically constructed of metal as depicted although it could be constructed of any suitable substitute material like fiberglass or plastic.

The bushing 10 includes a cross-sectionally U-shaped annular base cup 12 which supports a plurality of reinforcing members or wires 14 that extend outward from an annular slot of the base cup between its inner and outer walls to form a fence-like support for the elastomeric body. Wires 14 have a lower end portion 16 rigidly clamped between the side walls of base cup 12; a mid-portion forming a transition portion 18 and extending outward and upward from the lower end portion of the wires relative to a longitudinal central line of the swab cup; and a side wall forming portion 20 of the wires extending over a major length portion of the reinforcing structure or bushing. At the transition portion 18 of the wire structure, the wires are bent so the longitudinal axis of the wire above and below this portion is off set. Through this transition portion of the wires they are generally S-shaped to accomplish the desired off set. With the wires arranged in base cup 12 as shown in FIG. 2, the outer periphery portions of the wires lying around the outer perimeter of the cup define a frustoconical shape. In transition portion 18 the wires become spaced farther from one another than in base cup 12. When the elastomeric swab cup body material is molded around bushing 10, it fills the voids between the individual wire members in this transition portion as well as other portions of the structure.

FIG. 1 shows a hollow internal reinforcing member, indicated generally at 22, which is adapted to be mounted within the interior of reinforcing structure or bushing 10 as shown in the other figures of sheet 1. Reinforcing member 22 somewhat resembles a tubular segment of conduit having a smaller diameter side wall portion 24 connected by a transition portion 26 to a larger diameter side wall portion 28. At what is the lower end portion of smaller diameter side wall portion 24, the side wall is tapered to be slightly cross-sectionally thinner than the portions immediately above. The taper of side wall portion 30 is a result of the hollow reinforcing member 22 being formed by deforming the material thereof to have the elongated larger and smaller diameter portions. The interior surface of smaller diameter side wall portion 24 is indicated at 32. The internal diameter of smaller diameter side wall portion 24 is selected such that the smallest internal diameter of the swab cup will permit mounting of the swab cup on an appropriate mandrel of a swabbing tool. Larger diameter portion 28 of the reinforcing member has its interior 34 substantially uniform in circular cross-section.

Manufacture of the base cup can be accomplished by forming an annular plate of material, such as metal, into a U-shaped cup having substantially concentric inner and outer walls. The base cup can be formed by a stamping process so the finished cup has an annular bottom portion with inner and outer peripheral edges and inner and outer wall portions extending from the respective edges in a generally concentric parallel relationship forming an annular slot therebetween. The annular slot opens upwardly to receive straight lower end portions of the elongated wires when the swab cup components and complete assembly are positioned as shown in the drawings.

In assembling bushing 10, two different approaches can be utilized. In one often preferred manner of assembling a swab cup reinforcing bushing, base cup 12 is joined with wires 14 by positioning the wires within the annular slot of preformed base cup 12. Then base cup 12 is swedged to rigidly clamp the wires in an immobile position. The swedging can be done by positioning a mandrel through the interior of base cup 12 and striking the external periphery of the base cup with appropriate swedging tools or rams. Once the wires are joined to the base cup, then hollow internal reinforcing member 22 is positioned within the confines of bushing 10 in the location approximating that shown in FIG. 2 only with the lower end 36 of reinforcing member 22 positioned substantially at or slightly extending beyond the corresponding end 37 of base cup 12. When this is done, an appropriate mandrel is positioned through hollow internal reinforcing member 22 and the lower end portion of smaller diameter side wall portion 24 is mechanically deformed radially outwardly relative to the longitudinal axis of the bushing onto end portions of base cup 12 in order to mechanically lock or retain by frictional engagement reinforcing member 22 with base cup 12. The mechanical deformation of reinforcing member side wall lower end portion 30 can be done by an appropriate swedging or flaring tool that will mechanically displace side wall lower end portion 30 into rigid contact with base cup 12.

Another approach is assembling bushing 10 is to align wires 14 within preformed base cup 12 and also to position reinforcing member 22 within the interior of base cup 12 with the lower end 36 positioned substantially at or slightly extending beyond the base cup end 37. When this is completed, a suitable mandrel is placed within the interior of smaller diameter portion 24 to hollow reinforcing member 22 then the bushing is swedged from the exterior of base cup 12 to accomplish the mechanical lock between wires 14, base cup 12, and reinforcing member 22. Regardless of which method of assembling bushing 10 is utilized the end result is the structure shown in FIG. 2 with the wires rigidly supported by base cup 12 and hollow reinforcing member 22 rigidly mounted to base cup 12.

When the bushing is complete then the elastomeric body is molded around it. In this molding a traditionally preferred and simple method is to place the bushing in a mold cavity, then inject the elastomeric material and following that cure the material at an elevated temperature for a predetermined time. Another method of doing this molding is to wrap the bushing in bands of elastomeric material, place this in a mold cavity and cure it at an elevated temperature for a predetermined time. Yet another method of molding the swab cup body includes placing the bushing in a mold cavity then filling it with a compound that will cure at room temperature to form the needed resilient body around the bushing.

Figure 4:
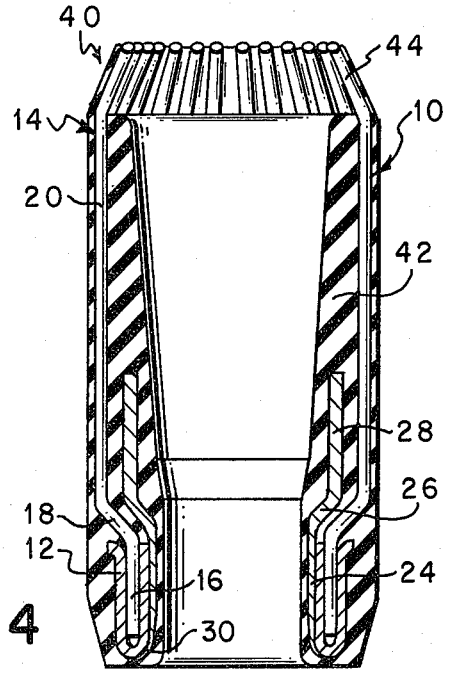
FIG. 4 is a cross-sectional view of a finished swab cup having the hollow internal reinforcement member shown in FIG. 1, with the view taken at the same location as FIG. 2.

FIG. 4 shows a completed swab cup, indicated generally at 40, made in accordance with this invention. The swab cup includes the internal reinforcing structure or bushing 10 enclosed within a body of elastomeric material 42. Once the elastomeric material is molded around the swab cup bushing, then the upper end portion 44 of wires 14 is deformed inward into a frustoconical relation as shown in FIG. 4.

The swab cup of this invention when completed and in use will have sufficient flexibility in wires 20 to permit their radially outward expansion against the walls of the well tubing under light load operating conditions. The swab cup also can withstand and operate well in heavy fluid load operating conditions because of reinforcing member 22. Reinforcing member 22 provides a structural stiffness in the lower portion of the swab cup where the elastomeric material spanning the wires of the reinforcing structure has the greatest unsupported span and accordingly where the resistance of this elastomeric material to fluid pressure could be expected to be lesser. Stiffening of the lower portion of bushing 10 by hollow internal reinforcing member 22 does not degrade the performance of the swab cup when used in the lighter load conditions because the upper portion of the structure is not appreciably influenced by the rigidity of member 22 so that it is not restrained in outward flecture under light load conditions. The swab cup made with reinforcing member 22 provides resistance to swab cup damage due to operation in heavy fluid load conditions by preventing rupture or blow out of the lower portion of the swab cup side wall.

In another embodiment, (2), of the swab cup of this invention is shown in FIGS. 5–8 on sheet 2 of the drawings. The swab cup of this embodiment is provided with a similar reinforcing bushing and it also has a hollow internal reinforcing member somewhat similar to that described above except for structural attachment and mounting within the bushing.

Because of similarity of the bushings in the two embodiments described herein, parts of the bushing of this embodiment, (2), have the same identifying numerals as that first described.

Referring to sheet 2 of the drawings and in particular FIGS. 5–8, the swab cup of this embodiment, (2), of this invention has a reinforcing structure or bushing, indicated generally at 50, for use in supporting the elastomeric swab cup body. This reinforcing structure is typically constructed of metal as depicted although it could be constructed of any suitable substitute material like fiberglass or plastic.

Figure 6:
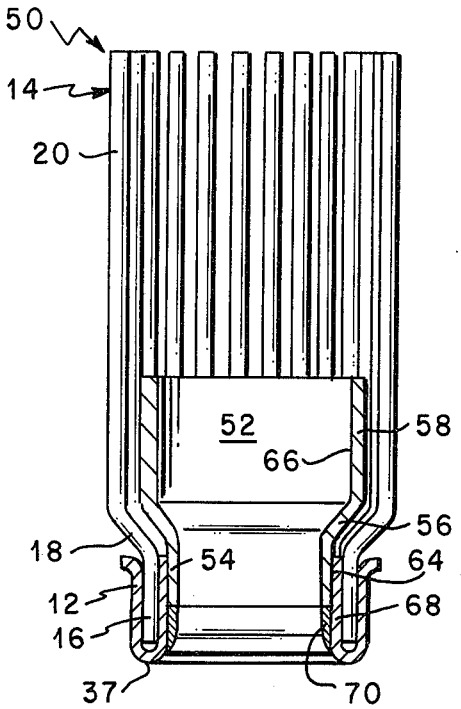
FIG. 6 is a cross-sectional side elevation view of a bushing or reinforcement member of FIG. 5 alone taken at the location of line 6—6 in FIG. 7 and having the hollow internal reinforcement member shown in FIG. 5.
Figure 7:
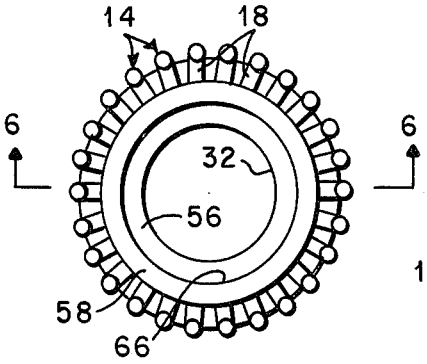
FIG. 7 is a top end view of the bushing or reinforcement structure shown in FIG. 6.

The bushing 50 includes a cross-sectionally U-shaped annular base cup 12 which supports a plurality of reinforcing members or wires 14 that extend outward from the closed end portion of the base cup to form a fence-like support for the elastomeric body. Wires 14 have a lower end portion 16 rigidly clamped between the side walls of base cup 12, a mid-portion forming a transition portion 18 and extending outward and upward from the lower end portion of the wires relative to a longitudinal central line of the swab cup; and a side wall forming portion 20 of the wires extending over a major length portion of the reinforcing structure. At the transition portion 18 of the wire structure, the wires are bent so the longitudinal axis of the wire above and below this portion is off set. With the wires arranged in base cup 12 as shown in FIG. 6, the outer periphery of their transition portion 18 lying around and above the outer perimeter of the cup define a frustoconical shape. In transition portion 18 the wires become spaced farther apart than in base cup 12. When the elastomeric swab cup body material is molded around bushing 50, it fills the voids between the individual wire members in this transition portion as well as other portions of the structure.

Figure 5:
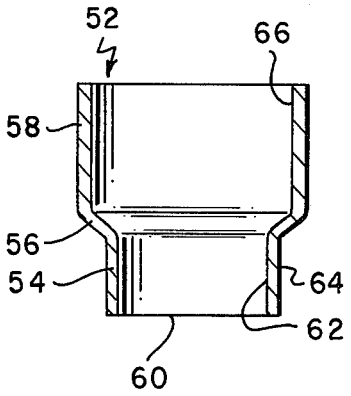
FIG. 5 is a cross-sectional view elevation view of a second embodiment, (2), of the hollow internal reinforcement member of this invention.

FIG. 5 shows a hollow internal reinforcing member, indicated generally at 52, which is adpated to be mounted within the interior of reinforcing structure or bushing 50 as shown in the other figures of sheet 2. Reinforcing member 52 somewhat resembles a tubular segment of conduit having a smaller diameter side wall portion 54 connected by a transition portion 56 to a larger diameter side wall portion 58. Smaller diameter side wall portion 54 terminates at a lower end 60 that is transverse to the longitudinal axis of the reinforcing member. The interior surface of smaller diameter side wall portion 54 is indicated at 62. The internal diameter of smaller diameter side wall portion 54 is selected such that the smallest internal diameter of the swab cup will permit mounting of the swab cup on an appropriate mandrel of a swabbing tool. The exterior 64 of smaller diameter side wall portion 54 is selected of a diameter to fit within the inside wall 68 of base cup 12 as shown in FIG. 6. Larger diameter portion 58 of the reinforcing member has its interior 66 substantially uniform in circular cross-section.

Manufacture of the base cup can be accomplished by forming an annular plate of material, such as metal, into a U-shaped cup having substantially concentric inner and outer walls. The base cup can be formed by a stamping process so the finished cup has an annular bottom portion with inner and outer peripheral edges and inner and outer wall portions extending from the respective edges in a generally concentric parallel relationship forming an annular slot therebetween. The annular slot opens upwardly to receive straight lower end portions of the elongated wires when the swab cup components and complete assembly are positioned as shown in the drawings.

In assembling bushing 50, base cup 12 is joined with wires 14 by positioning the wires within the annular slot of preformed base cup 12. Then base cup 12 is swedged to rigidly clamp the wires in an immobile position. The swedging can be done by positioning a mandrel through the interior of base cup 12 and striking the external periphery of the base cup with appropriate swedging tools or rams. Once the wires are joined to the base cup, then hollow internal reinforcing member 52 is positioned within the confines of bushing 50 in the location approximating that shown in FIG. 6 with the lower end 60 of reinforcing member 52 located at a mid-point of base cup inside wall 68. When this has been done, then hollow internal reinforcing member 52 is welded to the inside of base cup 12 inside of wall 68 in order to mechanically lock reinforcing member 52 with base cup 12. This welding deposits a ring of weld material 70 around the inside surface of base cup inside wall 68 and at the lower end portion of hollow internal reinforcing member small diameter wall portion 54 to join these pieces into a unitary structure. The welding can be done by commonly known processes of brasing, electric welding or gas welding at the desire of the user.

When the bushing is complete then the elastomeric body is molded around it. In this molding a preferred and simple method is to place the bushing in a mold cavity, then inject the elastomeric material and following that cure the material at an elevated temperature for a predetermined time. Another method of doing this molding is to wrap the bushing in bands of elastomeric material, place this in a mold cavity and cure it at an elevated temperature for a predetermined time. Yet another method of molding the swab cup body includes placing the bushing in a mold cavity then filling it with a compound that will cure at room temperature to form the needed resilient body around the bushing.

Figure 8:
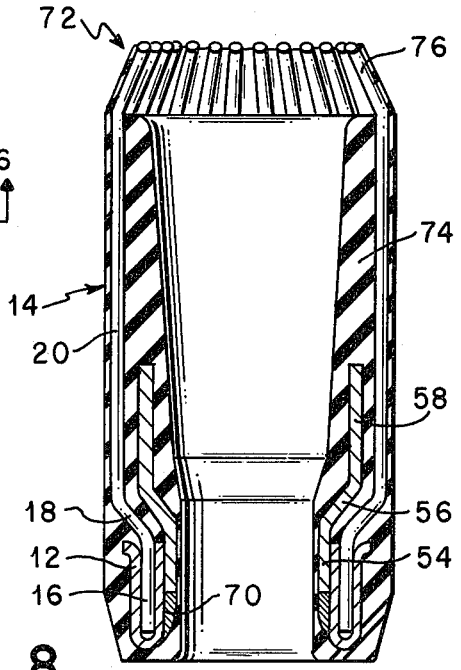
FIG. 8 is a cross-sectional view of a finished swab cup having the hollow internal reinforcement member shown in FIG. 5, with this view taken from the same position as FIG. 6.

FIG. 8 shows a completed swab cup, indicated generally at 72, made in accordance with this embodiment of this invention. The swab cup includes the internal reinforcing structure or bushing 50 enclosed within a body of elastomeric material 74. The elastomeric body 74 is molded so as to enclose bushing 50 within the elastomeric material. Once the elastomeric material is molded around the swab cup bushing, when the upper end portion 76 of wires 14 is deformed inward in a frustoconical relation at the upper end of the swab cup as shown in FIG. 8.

The swab cup of this invention when completed and in use will have sufficient flexibility in wires 20 to permit their radially outward expansion against the walls of the well tubing under light load operating conditions. The swab cup also can withstand and operate well in heavy fluid load operating conditions because of reinforcing member 52. Reinforcing member 52 provides a structural stiffness in the lower portion of the swab cup where the elastomeric material spanning the wires of the reinforcing structure has the greatest unsupported span and accordingly where the resistance of this elastomeric material to fluid pressure could be expected to be lesser. Stiffening of the lower portion of bushing 50 by hollow internal reinforcing member 52 does not degrade the performance of the swab cup when used in the lighter load conditions because the upper portion of the structure is not appreciably influenced by the rigidity of member 52 so that it is not restrained in outward flecture under light load conditions. The swab cup made with reinforcing member 52 provides resistance to swab cup damage due to operation in heavy fluid load conditions by preventing rupture or blow out of the lower portion of the swab cup side wall.

The embodiments of the invention in which an exclusive property of privilege is claimed are defined as follows:

1. An improved swab cup assembly comprising:

(a) a unitary base member of U-shaped cross-section formed from a single annular member having an inner opening and including an annular bottom portion having inner and outer peripheral edges and inner and outer wall portions from the respective inner and outer peripheral edges of said bottom portion, said wall portions extending in spaced, generally concentric parallel relationship forming an annular slot there-between, said inner wall portion including an inner surface;

(b) a plurality of elongated wire members having straight lower end portions, S-shaped intermedite portions, side wall forming portions over the major length thereof; and inwardly bent upper portions, said lower portions being disposed in said slot in circumferentially spaced relationship and in tight, frictional engagement with said wall portions whereby the lower end portions of said wire members are retained immobile with respect to said base member and each other;

(c) a hollow reinforcing member having a smaller diameter portion, a larger diameter portion and a transition portion integrally connected therebetween, said smaller diameter portion extending through the inner opening of said base member along said inner wall portion thereof with said transition portion positioned above said inner peripheral edge and said larger diameter portion positioned along the mid-portion of said side wall portions of said wire members, and means for rigidly securing said smaller diameter portion with said unitary base member against said inner surface to lock said reinforcing member against separation from said base member; and (d) elastomeric body means encapsulating said base member, said hollow reinforcing member and said wire members for forming said members into an annular swab cup assembly.

2. The improved swab cup of claim 1, wherein said means for rigidly securing said lower portion comprises frictional engagement thereof with said base member inner wall portion and a flared lower end portion at said base member bottom portion inner peripheral edge.

3. The improved swab cup of claim 1, wherein said means for rigidly securing said lower portion includes bonding said small diameter portion along an inner side of said base member inner wall portion to said base member adjacent said bottom portion inner peripheral edge thereof.

4. The improved swab cup of claim 1, wherein said means for rigidly securing said lower portion includes welding said smaller diameter portion along the interior of said base member inner wall portion adjacent a mid portion thereof.

5. A method of manufacturing a reinforcing structure for an elastomeric seal element, said method comprising:

(a) forming an annular plate into a U-shaped cup having a closed end and concentric inner and outer walls, said inner wall having an inner surface;

(b) locating in said U-shaped cup between said inner and outer walls a plurality of wire members in a upwardly projecting relation;

(c) securing said wire members in said U-shaped cup;

(d) locking a separate hollow tubular reinforcing member to the U-shaped cup against axial separation therefrom with the reinforcing member engaging said inner surface and with an unattached end extending upwardly within the confines of the structure as defined by the plurality of the wire members; and (e) molding an elastomeric body to the wire members, the hollow reinforcing member, and the U-shaped cup.

6. The method of claim 5, wherein said locking a reinforcing member comprises deforming a lower end portion of the reinforcing member to mechanically lock the reinforcing member with the U-shaped cup.

7. The method of claim 6, wherein the deforming of the reinforcing member comprises, flaring the reinforcing lower end portion against the U-shaped cup inner wall and against a bottom exterior of the U-shaped cup between the inner and outer walls.

8. The method of claim 5, wherein said locking a reinforcing member comprises bonding a lower end portion of the reinforcing member to the U-shaped cup inner wall.

9. The method of claim 5, wherein said locking a reinforcing member comprises welding the reinforcing member lower end portion to a mid-portion of the U-shaped cup inner wall.

* * * * *